US006694750B1

(12) United States Patent
Lifson et al.

(10) Patent No.: US 6,694,750 B1
(45) Date of Patent: Feb. 24, 2004

(54) REFRIGERATION SYSTEM EMPLOYING MULTIPLE ECONOMIZER CIRCUITS

(75) Inventors: Alexander Lifson, Manlius, NY (US); Yan Tang, Daphne, AL (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/224,759

(22) Filed: Aug. 21, 2002

(51) Int. Cl.[7] ..... F25B 41/00; F25B 1/00
(52) U.S. Cl. ..... 62/113; 62/513
(58) Field of Search ..... 62/113, 513, 115, 62/204, 227, 222, 210

(56) References Cited

U.S. PATENT DOCUMENTS 4,058,988 A * 11/1977 Shaw ..... 62/160
4,903,497 A * 2/1990 Zimmern et al. ..... 62/113
5,692,389 A * 12/1997 Lord et al. ..... 62/222
5,806,327 A * 9/1998 Lord et al. ..... 62/115
6,058,727 A * 5/2000 Fraser, Jr. et al. ..... 62/190
6,058,729 A * 5/2000 Lifson et al. ..... 62/217
6,113,358 A * 9/2000 Young et al. ..... 417/250
6,202,438 B1 * 3/2001 Barito ..... 62/513
6,385,981 B1 * 5/2002 Vaisman ..... 62/196.3
6,428,284 B1 * 8/2002 Vaisman ..... 417/213
6,539,720 B2 * 4/2003 Rouse et al. ..... 60/651
6,564,560 B2 * 5/2003 Butterworth et al. ..... 62/84

* cited by examiner

*Primary Examiner*—Melvin Jones
(74) *Attorney, Agent, or Firm*—Carlson, Gaskey & Olds

(57) ABSTRACT

The refrigeration system of the present invention includes multiple economizer circuits. After flowing through the condenser, a first path of refrigerant is split from the main path. The refrigerant in the first path is expanded to a lower pressure and cools the refrigerant in the main path in the high pressure economizer heat exchanger. The refrigerant in the first path then returns to the compressor in a high pressure economizer port. A second path of refrigerant is then split from the main path. The refrigerant in the second flow path is expanded to a lower pressure and cools the refrigerant in the main path in the low pressure economizer heat exchanger. The refrigerant in the second path then return to the compressor in a low pressure economizer port. The refrigerant in the main path is then evaporated. The dual stage economizer refrigeration system can be employed with a screw compressor or a scroll compressor.

14 Claims, 4 Drawing Sheets

REFRIGERATION SYSTEM EMPLOYING MULTIPLE ECONOMIZER CIRCUITS

BACKGROUND OF THE INVENTION

The present invention relates generally to a refrigeration system employing multiple economizer circuits to increase capacity and efficiency of the refrigeration system.

System capacity can be increased by increasing the subcooling of the refrigerant leaving the condenser. In a standard (non-economized) refrigeration system, the amount of subcooling typically ranges from 0 to 15° F. An economizer can be employed to additionally subcool the liquid refrigerant exiting the condenser, increasing the capacity and efficiency of the refrigeration system.

In an economized system, the refrigerant is split into two flow paths after leaving the condenser. The first flow path is expanded to a low pressure by an expansion valve prior to passing into the economizer heat exchanger. The second flow path flows directly into the economizer heat exchanger and is cooled by the refrigerant in the first flow path. The refrigerant from the first path then flows along an economizer return path and is injected through economizer ports into the compressor. The vapor refrigerant in the second path is then expanded by a main expansion valve. By employing an economizer, both system capacity and efficiency is increased.

It would be beneficial to employ multiple economizer circuits to further increase the capacity of the refrigeration system. The benefits of employing multiple economizer circuits are especially pronounced for a refrigeration system operating with a high discharge to suction pressure ratio. Multiple economizers have not been employed in prior refrigeration systems as the refrigerant flow from each of the economizers mixes at the point of injection. For example, prior screw compressors include a pair of rotors. As only two rotors are employed, the rotational angle of the compression process is not large enough to prevent vapor communication among the suction port, the low pressure economizer port, the high pressure economizer port, and the discharge port.

SUMMARY OF THE INVENTION

The multiple stage economizer refrigeration system of the present invention includes a compressor, a condenser, a high pressure economizer circuit, a low pressure economizer circuit, expansion valves, and an evaporator. After the refrigerant exits the condenser, the refrigerant splits into two flow paths. The first path of refrigerant is expanded to a lower pressure in an expansion valve prior to flowing into the high pressure economizer heat exchanger. Refrigerant from the main path flows through the high pressure economizer heat exchanger and is cooled by the refrigerant in the first path. The refrigerant in the first path is returned to the compressor through the high pressure economizer port.

After being cooled in the high pressure economizer, the refrigerant from the main path again splits into two flow paths. Refrigerant in the second path is expanded to a low pressure in an expansion valve prior to flowing into the low pressure economizer heat exchanger. Refrigerant from the main path passes through the low pressure economizer heat exchanger and is cooled by the refrigerant in the second path. The refrigerant from the second path is returned to the compressor through the low pressure economizer port. Thus, additional subcooling of the main flow of the refrigerant is accomplished by subcooling in two stages. For even greater subcooling benefits, more than to stages can be implemented.

After being cooled in the low pressure economizer heat exchanger, the refrigerant is expanded in the main expansion valve, heated in the evaporator, and enters the compressor at the suction port. After compression, the refrigerant is discharged through the discharge port.

The multiple economizer refrigeration system can be employed in a screw compressor or a scroll compressor. The screw compressor includes a male rotor including a plurality of helical threads and a pair of opposing female rotors each including a plurality of helical threads. The helical threads of the male rotor engage the helical threads of the female rotors to create two sets of compression chambers. One set of compression chambers communicates with refrigerant from the high pressure economizer, and the other set of compression chambers communicates with refrigerant from the low pressure economizer.

Alternately, a scroll compressor is employed in the multiple economizer refrigeration system. Vapor refrigerant from the low pressure economizer is injected into the scroll compressor through a pair of low pressure injections ports. The low pressure ports are located such that vapor injection initiates shortly after the suction port is covered and the compression chambers are sealed from suction. Vapor refrigerant from the high pressure economizer is injected into the scroll compressor through a high pressure injection port. The high pressure injection port is located proximate to the discharge port. Refrigerant injection through the high pressure injection port and the low pressure injection ports occurs into separate scroll compressor pockets.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
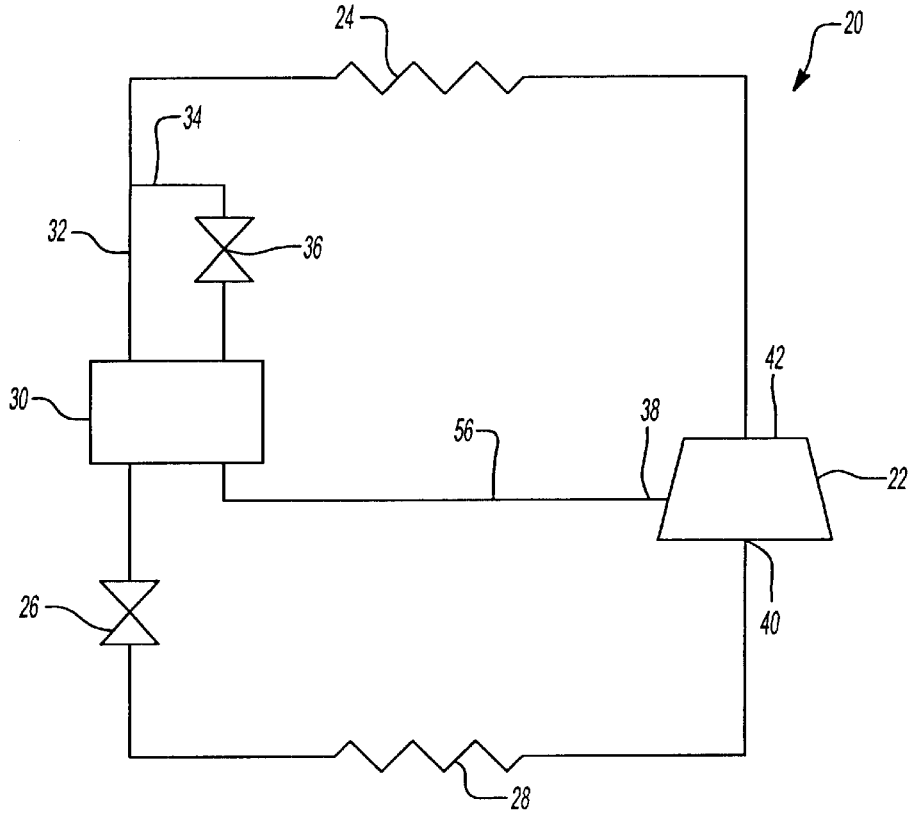
Fig-1 PRIOR ART
FIG. 1 illustrates a schematic diagram of a prior art refrigeration system employing a single economizer circuit.
Figure 2:
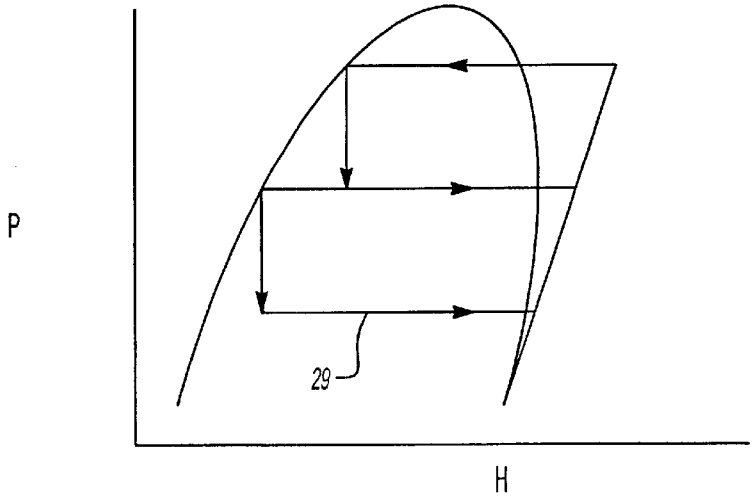
Fig-2 PRIOR ART
FIG. 2 illustrates a graph relating pressure to enthalpy for the prior art refrigeration system of FIG. 1.

FIG. 1 illustrates a schematic diagram of a prior art single economizer refrigeration system 20. The system 20 includes a compressor 22, a condenser 24, a main expansion device 26, an evaporator 28, and an economizer heat exchanger 30. Refrigerant circulates though the closed circuit system 20. After the refrigerant exits the compressor 22 through the discharge port 42 at high pressure and enthalpy, the refrigerant loses heat in the condenser 24, exiting at lower enthalpy and high pressure. The refrigerant then splits into two flow paths 32 and 34. Refrigerant in path 34 is expanded to a low pressure in the expansion valve 36 prior to flowing through the economizer heat exchanger 30. As the refrigerant in the path 32 flows through the economizer heat exchanger 30, it is cooled by the refrigerant in path 34. Refrigerant in path 34 from the economizer heat exchanger 30 is returned along the economizer return path 56 to the compressor 22 through the economizer port 38 at a pressure between the suction pressure and the discharge pressure. The refrigerant in line 32 is expanded by the main expansion device 26 and then heated in the evaporator 28. The refrigerant enters the compressor 22 at the suction port 40. Downstream, this refrigerant mixes with the refrigerant from the return path 56. A graph relating enthalpy to pressure for the refrigeration system 20 is illustrated in FIG. 2. The length of the evaporation line 29 illustrates the cooling capacity of the system 20.

Figure 3:
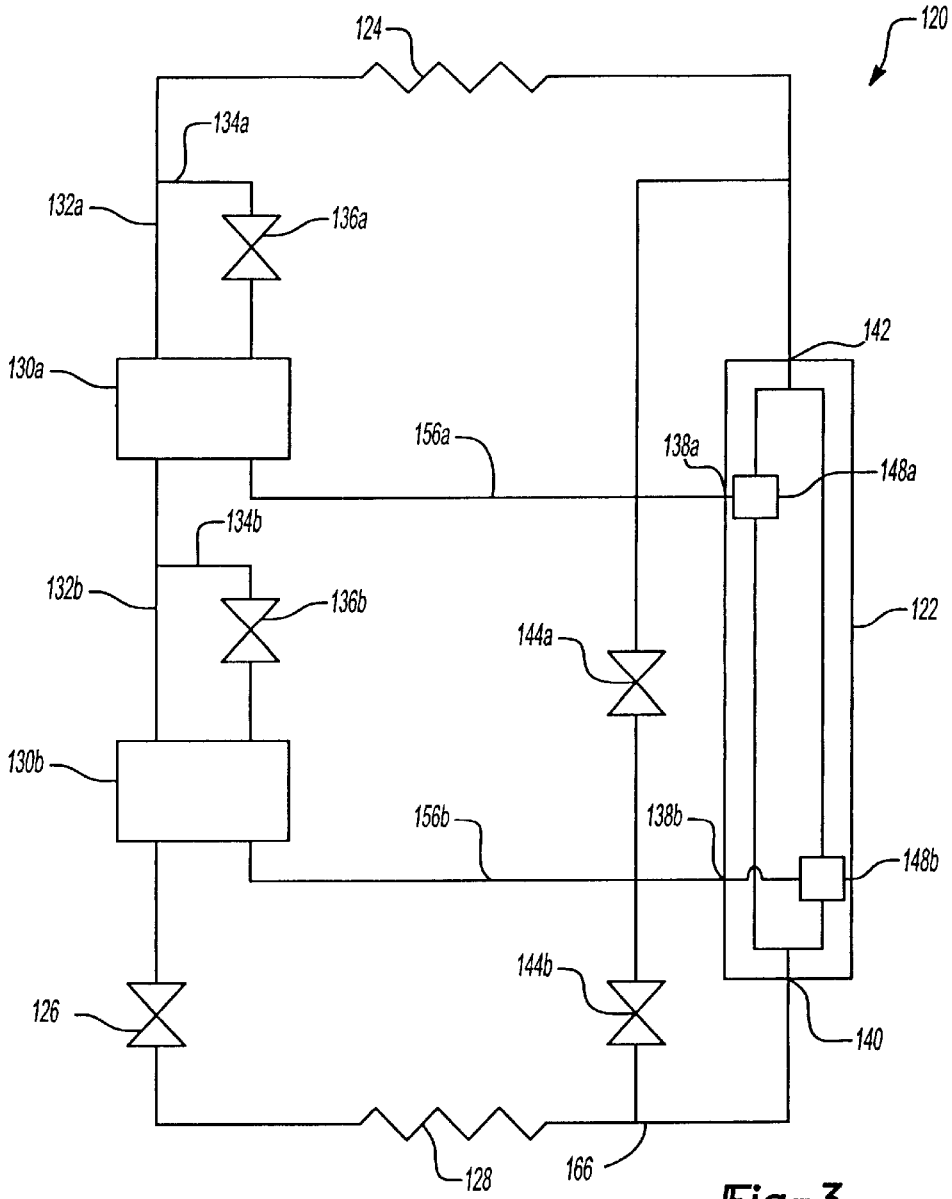
FIG. 3 illustrates a schematic diagram of the refrigeration system of the present invention employing dual economizer circuits.

FIG. 3 illustrates a schematic diagram of the refrigeration system 120 of the present invention employing dual economizer heat exchangers 130*a* and 130*b*. The system 120 includes a compressor 122, a condenser 124, a high pressure economizer heat exchanger 130*a*, a low pressure economizer heat exchanger 130*b*, an expansion valve 126, and an evaporator 128. After the refrigerant exits the compressor 122 at high pressure and enthalpy through the discharge port 142, the refrigerant loses heat in the condenser 124, exiting the condenser 124 at low enthalpy and high pressure. The refrigerant then splits into two flow paths 132*a* and 134*a*. Refrigerant in path 134*a* is expanded to a low pressure by the low pressure expansion valve 136*a* prior to flowing through the economizer heat exchanger 130*a*. As the refrigerant in the path 132*a* flows through the high pressure economizer heat exchanger 130*a*, it is cooled by the refrigerant in path 134*a*. Refrigerant from the economizer heat exchanger 130*a* is returned along the economizer return path 156*a* to the compressor 122 through the high pressure economizer port 138*a* for compression in compression chambers 148*a*.

After being cooled in the high pressure economizer heat exchanger 130*a*, the refrigerant in path 132*a* splits into two flow paths 132*b* and 134*b*. Refrigerant in path 134*b* is expanded to a low pressure by the low pressure expansion valve 136*b* prior to flowing through the low pressure economizer heat exchanger 130*b*. As the refrigerant in the path 132*b* flows through the low pressure economizer heat exchanger 130*b*, it is cooled by the refrigerant in path 134*b*. Refrigerant in path 134*b* from the economizer heat exchanger 130*b* is returned along the economizer return path 156*b* to the compressor 122 through the low pressure economizer port 138*b* for compression in compression chambers 148*b*.

Refrigerant from path 132*b* is then expanded in the main expansion valve 126. The main expansion valve 126, as well as the high pressure and low pressure expansion valves 136*a* and 136*b*, can be electronic EXV (electric expansion vales) or TXV valves. After evaporation in the evaporator 128, the refrigerant enters the compressor 122 through the suction port 140. Refrigerant from the paths 134*a* and 134*b* enters the compressor 122 through the high pressure economizer port 138*a* and the low pressure economizer port 138*b*, respectively, and mixes with the refrigerant in the compressor 122 for compression.

The economizer ports 138*a* and 138*b* communicate with the compression chambers 148*a* and 148*b*, respectively, which are each at a pressure which varies during the compression cycle of the compressor 122. To prevent high pressure to low pressure leak of refrigerant from line 156*a* to 156*b*, the refrigerant from the economizer heat exchangers 130*a* and 130*b* which flows in the compression chambers 148*a* and 148*b* must remain separate at the point of injection in the compressor 122.

Multiple steps of compressor 122 unloading are also possible with the system 120 of the present invention. In one step, both of the economizer heat exchangers 130*a* and 130*b* are engaged. Alternatively, in additional steps, either of the economizer heat exchangers 130*a* and 130*b* can be disengaged by shutting off the expansions valves 136*a* and 136*b*, respectively. Both of the economizer heat exchangers 130*a* and 130*b* can be disengaged for non-economized operation by shutting off both of the expansion valves 136*a* and 136*b*.

To regulate capacity of the system 120, two additional solenoid valves 144*a* and 144*b* may be employed. A first solenoid valve 144*a* regulates the flow of refrigerant between the high pressure economizer port 138*a* and the low pressure economizer port 138*b*. A second solenoid valve 144*b* regulates the flow of refrigerant between the low pressure economizer port 138*b* and the compressor suction port 140.

The solenoid valves 144*a* and 144*b* can be opened or closed depending on system 120 requirements to achieve steps of compressor 122 or system 120 unloading. By opening the solenoid valves 144*a* and 144, the refrigerant flow from both the high pressure and the low pressure economizer ports 138*a* and 138*b* can be by-passed into the suction port 140 to reduce cooling. Alternately, by opening the solenoid valve 144*a* and closing the solenoid valve 144*b*, the refrigerant flow from the high pressure economizer port 138*a* can be by-passed into the economizer port 138*b*. Alternately, by closing the solenoid valve 144*a* and opening the solenoid valve 144*b*, the refrigerant flow from the low pressure economizer port 138*b* can be bypassed into suction line 166.

By controlling the expansion valves 136*a* and 136*b* and solenoid valves 144*a* and 144*b*, the operation of the compressor 122 and system 120 can be adjusted to meet the cooling demands and achieve optimum capacity and efficiency. A worker of ordinary skill in the art would know how to control these valves depending on the system 120 requirements.

Figure 4:
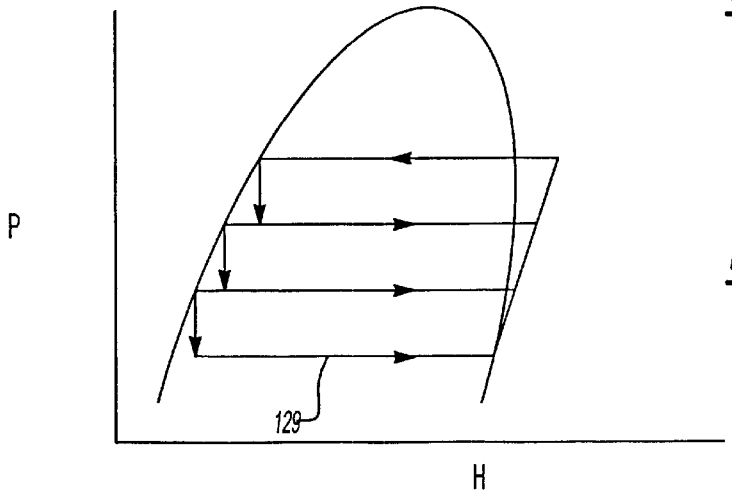
FIG. 4 illustrates a graph relating pressure to enthalpy for the refrigeration system of FIG. 4.

FIG. 4 illustrates a graph relating enthalpy to pressure for the refrigeration system 120 of FIG. 3 employing dual economizer heat exchangers 130*a* and 130*b*. As shown, the evaporation line 129 of the refrigerant system 120 is longer than the evaporation line 29 of the refrigeration system 20 employing one economizer 30 (illustrated in FIG. 2). This indicates that the refrigeration system 120 employing dual economizers 130*a* and 130*b* has a greater cooling capacity than the refrigeration system 20 employing a single economizer 30.

Figure 5:
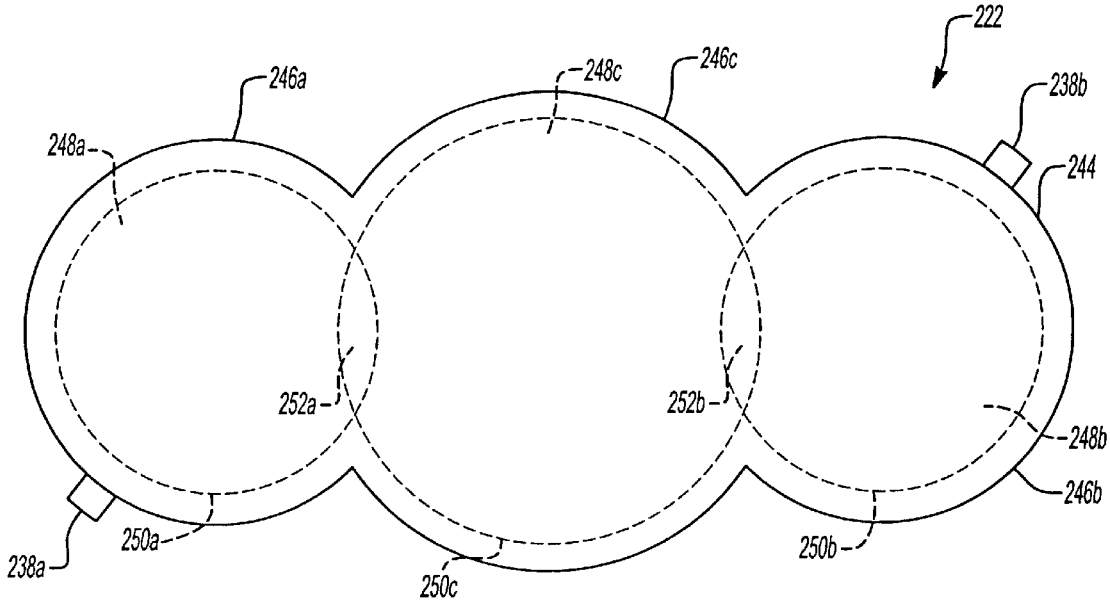
FIG. 5 illustrates a cross sectional view of a screw compressor employed in a refrigerant system utilizing dual economizers taken along line 5—5 of FIG. 6.

FIG. 5 illustrates a cross-sectional view of a tri-rotor screw compressor 222 employed in the dual economizer system 120 of the present invention. The screw compressor 222 includes a housing 244 having a central portion 246*c* and a pair of opposing portions 246*a* and 246*b*. The central portion 246*c* houses a male rotor 248*c* including a plurality of helical threads 250*c*. The opposing portions 246*a* and

246*b* each house a female rotor 248*a* and 248*b*, each including a plurality of helical threads 250*a* and 250*b*, respectively. The helical threads 250*c* of the male rotor 248*c* engage the helical threads 250*b* of the female rotors 248*a* and 248*b*, respectively, to create high pressure compression chambers 252*a* and low pressure compression chambers 252*b*, respectively. Refrigerant from the high pressure economizer 130*a* enters the compressor 222 through the high pressure economizer port 238*a* and is compressed in the high pressure compression chambers 252*a*. Refrigerant from the low pressure economizer 130*b* enters the compressor 222 through the low pressure economizer port 238*b* and is compressed in the low pressure compression chambers 252*b*. As the refrigerant from the economizer heat exchangers 130*a* and 130*b* is injected into the compressor 222 through separate economizer ports 238*a* and 238*b*, respectively, the refrigerant from the economizers 130*a* and 130*b* remains separate at the point of injection into the compressor 222.

Figure 6:
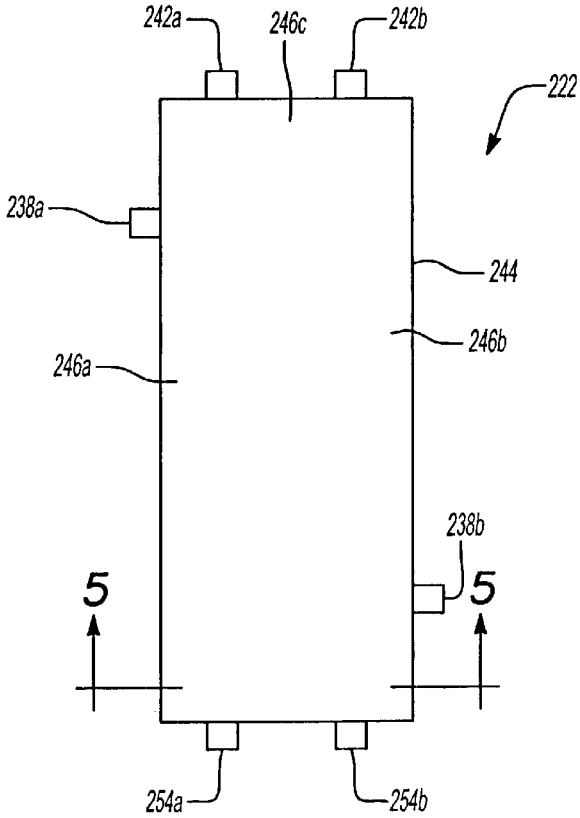
FIG. 6 illustrates a top view of the screw compressor of FIG. 5.

After evaporation, the refrigerant splits into two streams. As shown in FIG. 6, one stream enters the suction port 254*a* for compression in the compression chambers 252*a* with the refrigerant from the high pressure economizer 130*a*, and the other stream enters suction port 254*b* for compression in the compression chambers 252*b* with refrigerant from the low pressure economizer 130*b*. After compression, the refrigerant in the compression chambers 252*a* and 252*b* is discharged through the discharge ports 242*a* and 242*b*, respectively, for condensation. As shown, the low pressure economizer port 238*b* is positioned closer to the suction ports 254*a* and 254*b*, and the high pressure economizer port 238*a* is positioned closer to the discharge ports 254*a* and 254*b*.

As the compression chambers 252*a* and 252*b* are separate and are on opposing sides of the housing 244, there is no communication between the refrigerant from the high pressure economizer 230*a* and the refrigerant from the low pressure economizer 230*a*. By optimizing the position and size of economizer ports 238*a* and 238*b*, vapor communication between the compression chambers 252*a* and 252*b*, the suction ports 240*a* and 240*b*, and the discharge ports 242*a* and 242*b* is prevented, allowing for control of the pressure in each economizer 130*a* and 130*b*.

Figure 7:
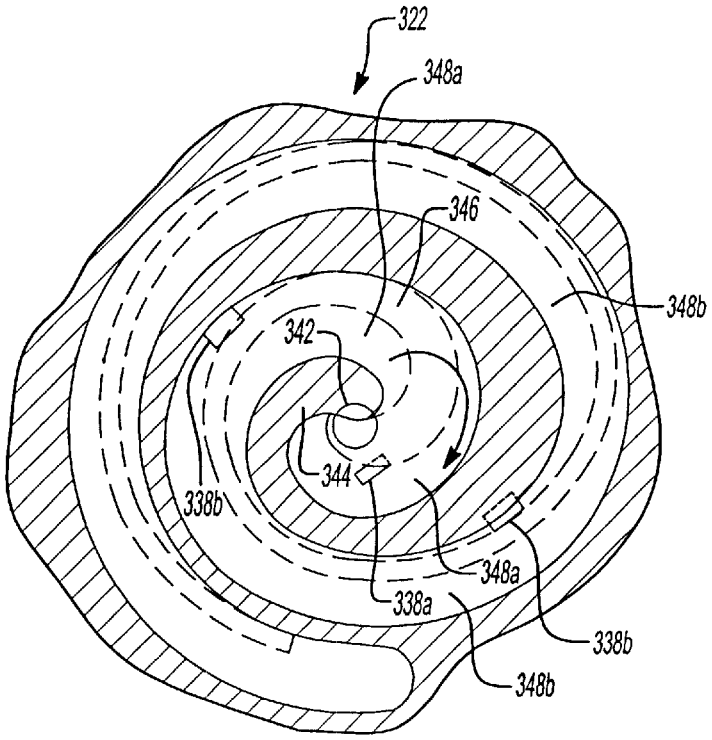
FIG. 7 illustrates a scroll compressor employed in a refrigerant system utilizing dual economizers when injection of refrigerant begins.

FIG. 7 illustrates a scroll compressor 322 employed in the refrigeration system 120 employing dual economizer heat exchangers 130*a* and 130*b*. The scroll compressor 322 includes a non-orbiting scroll 344, an orbiting scroll 346, and a plurality of compression chambers 348*a* and 348*b* defined therebetween.

As the refrigerant from the economizer heat exchangers 130*a* and 130*b* is injected into the compressor 322 through separate economizer ports 338*a* and 338*b*, respectively, and as long as solenoid valve 144*a* remains closed, the refrigerant in lines 156*a* and 156*b*, respectively, remains separate, and there is no communication between compression chambers 348*a* and 348*b*.

Vapor refrigerant from the low pressure economizer heat exchanger 130*b* is injected into a pair of compression chambers 348*b* of the scroll compressor 322 through a pair of low pressure injections ports 338*b*. Vapor refrigerant from the high pressure economizer heat exchanger 130*a* is injected into the compression chambers 348*a* of the scroll compressor 322 through a high pressure injection port 338*a*. The high pressure injection port 338*a* is located proximate to the discharge port 342. The injection ports 338*a* and 338*b* typically extend through the body of the fixed scrolls 344 and into the compression chambers 348*a* and 348*b*, respectively.

FIG. 7 illustrates the position of scroll compressor 322 when injection of refrigerant from the dual economizer heat exchangers 130*a* and 130*b* begins. The injection ports 338*a* and 338*b* have just opened to allow the vapor refrigerant from each economizer heat exchanger 130*a* and 130*b* to enter the compression chambers 348*a* and 348*b*, respectively.

Figure 8:
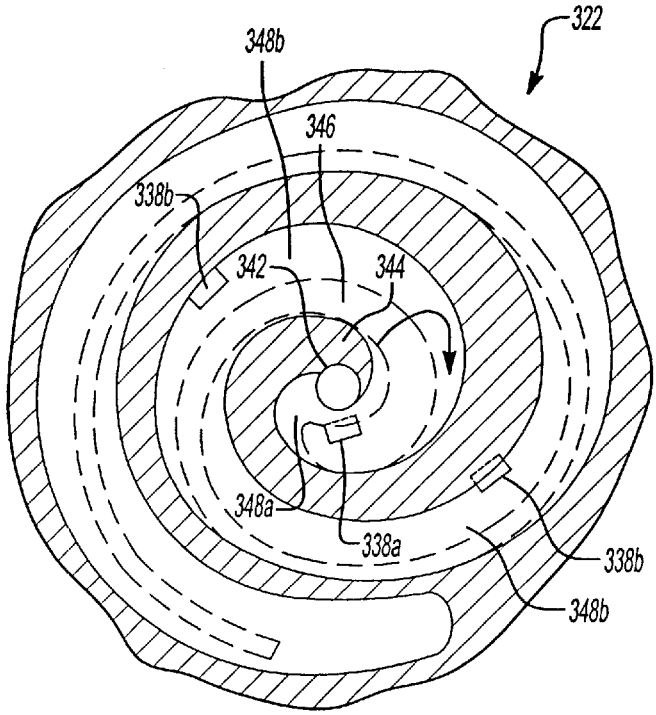
FIG. 8 illustrates the scroll compressor of FIG. 7 when injection of the refrigerant from the low pressure economizer is still in progress, and injection of refrigerant from the high pressure economizer is almost complete.

FIG. 8 illustrates the position of the scroll compressor 322 when refrigerant injection from the low pressure economizer 130*b* into the compression chambers 348*b* is still in progress and refrigerant injection from the high pressure economizer 130*a* into the compression chamber 348*a* is almost complete. At this stage, the high pressure injection port 338*a* is separated from the discharge port 342 as the high pressure injection port 338*a* is still covered by the orbiting scroll 346 prior to the initiation of the discharge process through a discharge valve that may cover the discharge port.

The scroll compressor 322 can alternatively include additional injection ports and compression chambers to allow for three ore more economizer heat exchangers. If three economizers are to be employed, the scroll compressor 322 will preferably have more than 2.5 turns.

There are several benefits to the refrigerant system 120 of the present invention. For one, a higher operating efficiency is possible employing multiple economizer heat exchangers 130*a* and 130*b*. Additionally, an increase in refrigeration capacity is possible. Compressor reliability is also improved due to a decrease in the discharge temperature. Control of system capacity is also increased by alternating the engagement of economizer circuits, as well as initiating bypass operation between the economizer circuits or between any of the economizer circuits and suction line.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A refrigeration system comprising:

a compressor for compressing a refrigerant to a high pressure, said compressor including a discharge portion, a suction port, a high pressure economizer port, and a low pressure economizer port, and said refrigerant exits said compressor through said discharge port;

a condenser for cooling said refrigerant;

a high pressure economizer heat exchanger, said refrigerant being split into a fist high passage provided with a high pressure expansion device and a second high passage and then exchanging heat therebetween in said high pressure economizer heat exchanger, said first high passage returning to said compressor through said high pressure economizer port and said second high passage flowing to a low pressure economizer heat exchanger;

said low pressure economizer heat exchanger, said refrigerant from said second high passage being split into a first low passage provided with a low pressure expansion device and a second low passage and then exchanging heat therebetween in said low pressure economizer heat exchanger, said first low passage returning to said compressor through said low pressure economizer port and said second low passage flowing to an expansion device;

said expansion device for reducing said refrigerant to a low pressure;

an evaporator for evaporating said refrigerant, and said refrigerant from said evaporator enters said compressor through said suction port;

a first valve to control a flow of said refrigerant between said high pressure economizer port and said low pressure economizer port of said compressor; and a second valve to control a flow of said refrigerant between said low pressure economizer port and said suction port of said compressor.

2. A refrigeration system comprising:

a compressor for compressing a refrigerant to a high pressure, wherein said compressor is a screw compressor including a male rotor, a first female rotor, and a second female rotor, each of said rotors having a plurality of threads, said plurality of threads of said male rotor said plurality of threads of said first female rotor engaging to create a plurality of high pressure compression chambers, and said plurality of threads of said male rotor and said plurality of threads of said second female rotor engaging to create a plurality of low pressure compression chambers;

a condenser for cooling said refrigerant;

a high pressure economizer heat exchanger, said refrigerant being split into a first high passage provided with a high pressure expansion device and a second high passage and then exchanging heat therebetween in said high pressure economizer heat exchanger, said first high passage returning to said compressor and said second high passage flowing to a low pressure economizer heat exchanger and said refrigerant from said first high passage of said high pressure economizer flows into said high pressure compression chambers of said compressor;

said low pressure economizer heat exchanger, said refrigerant from said second high passage being split into a first low passage provided with a low pressure expansion device and a second low passage and then exchanging heat therebetween in said low pressure economizer heat exchanger, said first low passage returning to said compressor and said second low passage flowing to an expansion device, and said refrigerant from said first low passage low pressure economizer flows into said low pressure compression chambers of said compressor;

said expansion device for reducing said refrigerant to a low pressure; and an evaporator for evaporating said refrigerant.

3. The system as recited in claim 2 wherein said refrigerant from said evaporator enters said screw compressor through a high pressure suction port and a low pressure suction port for compression of said refrigerant in said high pressure and said low pressure precession chambers, respectively, and said refrigerant from said low pressure and said high pressure economizer heat exchangers enters said low pressure and said high pressure compression chambers, respectively, through a low pressure and a high pressure economizer port, respectively, and said refrigerant in said high pressure and said low pressure compression chambers exits said compressor through a high pressure and a low pressure discharge port, respectively.

4. A refrigeration system comprising:

a compressor for compressing a refrigerant to a high pressure, and said compressor is a scroll compressor including a non-orbiting scroll member including a base and a generally spiral wrap extending from said base and an orbiting scroll member including a base and a generally spiral wrap extending from said base, said generally spiral wrap of said non-orbiting and orbiting scroll members interfitting to define at least one compression chamber, one of said scroll members having at least one high pressure economizer port and at least one low pressure economizer;

a condenser for cooling said refrigerant, a high pressure economizer heat exchanger, said refrigerant being split into a first high passage provided with a high pressure expansion device and a second high passage and then exchanging heat therebetween in said high pressure economizer heat exchanger, said first high passage returning to said compressor and said second high passage flowing to a low pressure economizer heat exchanger; and said refrigerant from said first high path of said high pressure economizer heat exchanger flows into said high pressure compression chambers through said at least one high pressure economizer port;

said low pressure economizer heat exchanger, said refrigerant from said second high passage being spilt into a first low passage provided with a low pressure expansion device and a second low passage, and then exchanging heat therebetween in said low pressure economizer heat exchanger, said first low passage returning to said compressor and said second low passage flowing to an expansion device, and wherein said refrigerant from said first low path of said low pressure economizer heat exchanger flows into said at least one low pressure compression chamber through said at least one low pressure economizer port;

said expansion device for reducing said refrigerant to a low pressure; and an evaporator for evaporating said refrigerant.

5. The system as recited in claim 9 wherein communication of said refrigerant between said high pressure economizer heat exchanger and said low pressure economizer heat exchanger is prevented at said at least one high pressure economizer port and said at least one low pressure economizer port.

6. The system as recited in claim 9 wherein said refrigerant is injected through said at least one high pressure economizer port and said at least one low pressure economizer port into at least one high pressure compression chamber and at least one low pressure compression chamber, respectively.

7. The system as recited in claim 9 wherein said refrigerant flows through said at least one low pressure economizer port and said at least one high pressure economizer port when a suction port of said compressor is closed, and said refrigerant from said evaporator enters said compressor through said suction port of said compressor.

8. The system as recited in claim 1 wherein said injection at least one high pressure economizer port and said at least on one low pressure economizer port are closed when a discharge port of said compressor is opened, and said refrigerant traveling to said condenser exits said compressor through said discharge port of said compressor.

9. The system as recited in claim 1 wherein said first valve and said second valve are opened to bypass said refrigerant from said high pressure economizer port and said low pressure economizer port into said suction port.

10. The system as recited in claim 1 wherein said first valve is opened and said second valve is closed to bypass said refrigerant from said high pressure economizer port into said low pressure economizer port.

11. The system as recited in claim 1 wherein said first valve is closed and said second valve is opened to bypass said refrigerant from said low pressure economizer port into said suction port.

12. The system as recited in claim 1 wherein at least one of said high pressure expansion device and said low pressure expansion device is closed.

13. The system as recited in claim 1 wherein said first valve and said second valve are solenoid valves.

14. A method of operating a refrigeration system comprising the steps of:

compressing a refrigerant to a high pressure;

cooling said refrigerant;

subcooling said refrigerant by splitting said refrigerant into a first passage and a second passage, expanding said refrigerant in said first passage, exchanging heat between said refrigerant in said first passage and said refrigerant in said second passage, returning said refrigerant in said first passage to said step of compressing through a high pressure economizer port, and flowing said refrigerant in said second passage to a step of further subcooling;

further subcooling said refrigerant by splitting said refrigerant into a first passage and a second passage, expanding said refrigerant in said first passage, exchanging heat between said refrigerant in said first passage and said refrigerant in said second passage, returning said refrigerant in said first passage to said step of compressing through a low pressure economizer port, and flowing said refrigerant in said second passage to a step of expanding;

expanding said refrigerant to a low pressure;

evaporating said refrigerant, and said refrigerant from the step of evaporating enters the step of compressing through a suction port;

controlling a flow of said refrigerant between said high pressure economizer port and said low pressure economizer port; and controlling a flow of said refrigerant between said low pressure economizer port and said suction port.

* * * * *

UNITED STATES PATENT AND TRADEMARK OFFICE

CERTIFICATE OF CORRECTION

PATENT NO. : 6,694,750 B1
DATED : February 24, 2004
INVENTOR(S) : Lifson et al.

It is certified that error appears in the above-identified patent and that said Letters Patent is hereby corrected as shown below:

Column 6,
Line 55, please change “fist” to read as -- first --.

Column 7,
Line 59, please change “prescession” to read as -- compression --.

Column 8,
Lines 42, 48 and 54, please change “9” to read as -- 4 --.
Line 60, please change “1” to read as -- 6 --.

Signed and Sealed this

Eighteenth Day of January, 2005

JON W. DUDAS
*Director of the United States Patent and Trademark Office*